US005305924A

United States Patent [19]

Groover et al.

[11] Patent Number: 5,305,924

[45] Date of Patent: Apr. 26, 1994

[54] BEVERAGE DISPENSER

[75] Inventors: Phillip B. Groover, Woodstock; Kirk W. Charles, Austell; Lionel D. Gillespie, Atlanta, all of Ga.; Samuel Durham, San Antonio, Tex.; Lisa C. Wandrick, Atlanta, Ga.

[73] Assignee: The Coca-Cola Company, Atlanta, Ga.

[21] Appl. No.: 60,892

[22] Filed: May 12, 1993

[51] Int. Cl.[5] ..... B67D 5/56

[52] U.S. Cl. ..... 222/129.1; 222/78; 222/173; 222/504; 137/377; 137/607

[58] Field of Search ..... 222/78, 108, 129.1-129.4, 222/173, 183, 504, 505, 509; 137/607, 377, 383; 251/261, 263

[56] References Cited

U.S. PATENT DOCUMENTS

| | | | |
|---|---|---|---|
| 2,934,243 | 4/1960 | Metzger | 222/173 X |
| 3,009,653 | 11/1961 | Hedeman | 222/129.4 X |
| 3,104,089 | 9/1963 | Seltsam | 251/263 |
| 3,625,402 | 12/1971 | Kulis | 222/504 X |
| 3,752,192 | 8/1973 | Kleppin | 222/183 X |
| 3,800,826 | 4/1974 | McCann | 222/129.1 X |
| 3,902,636 | 9/1975 | Zilk | 222/129.1 |
| 4,226,344 | 10/1980 | Booth et al. | 222/504 |
| 4,497,343 | 2/1985 | Brown et al. | 222/129.1 |
| 4,577,782 | 3/1986 | Fessler | 222/505 X |
| 4,741,355 | 5/1988 | Credle, Jr. et al. | 222/129.1 |
| 5,232,129 | 8/1993 | Guerra | 222/183 |

FOREIGN PATENT DOCUMENTS

| | | | |
|---|---|---|---|
| 0467415 | 1/1992 | European Pat. Off. | 222/129.1 |
| 2208224 | 3/1989 | United Kingdom | 222/129.1 |

OTHER PUBLICATIONS

Cecilware brochure-"Iced Tea Brewing Machines".

*Primary Examiner*—Kevin P. Shaver
*Attorney, Agent, or Firm*—Thomas R. Boston; W. Dexter Brooks

[57] ABSTRACT

A postmix beverage dispenser having the appearance of a stainless steel brewed tea urn. A postmix dispensing valve is mounted inside the tea urn and is operated by a handle located on the front of the tea urn. A nozzle extender is inside the handle body and connects to the nozzle of the dispensing valve. The handle body and nozzle extender are easily manually removed without tools from outside the tea urn.

6 Claims, 5 Drawing Sheets

BEVERAGE DISPENSER

BACKGROUND OF THE INVENTION

This invention relates to beverage dispensers and in particular to a postmix tea dispenser.

A wide variety of postmix beverage dispensers are known, including a housing, a dispensing valve for controlling the ratio of the water and concentrate, a spout on the valve, and a drip tray/cup support below the spout.

SUMMARY OF THE INVENTION

The dispenser of the present invention, in the preferred embodiment, has the appearance of a stainless steel brewed tea dispenser and includes inside the urn a postmix beverage dispensing valve, such as that shown in U.S. Pat. No. 4,741,355. Water and tea concentrate conduits feed water and concentrate, respectively, to the valve from the local water supply and from a tea concentrate container located outside the tea urn. The dispensing valve controls the ratio of water to concentrate, as is well-known in the postmix beverage dispenser field. A handle is attached to the front of the tea urn to operate the dispensing valve. The handle body includes a nozzle extender connected to the nozzle of the dispensing valve.

BRIEF DESCRIPTION OF THE DRAWINGS

The present invention will be more fully understood from the detailed description below when read in connection with the accompanying drawings wherein like reference numerals refer to like elements and wherein.

DETAILED DESCRIPTION OF THE PREFERRED EMBODIMENT

Figure 1:
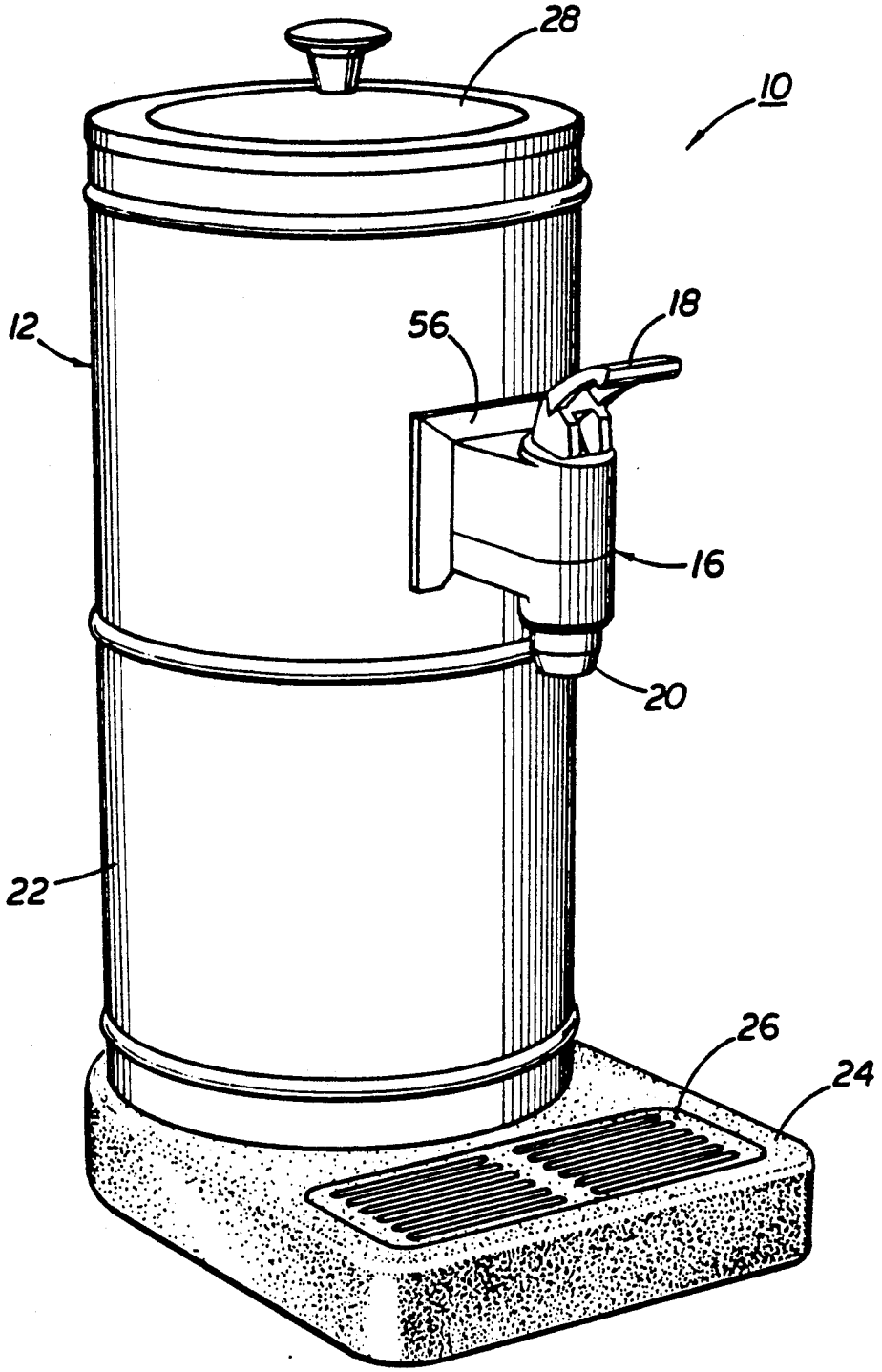
FIG. 1 is a front, top, left side perspective view of the dispenser of this invention.

With reference now to the drawings, FIGS. 1–6 show the postmix beverage dispenser 10 of the present invention, having the appearance of a stainless steel iced tea urn. The dispenser 10 includes a hollow housing 12, a postmix beverage dispensing valve 14 mounted inside the housing and a handle body 16 with a handle 18 and dispensing spout 20 mounted on the outside front of the housing 12.

The housing 12 preferably includes a stainless steel cylinder 22 mounted on a base 24 having a drip tray/cup support 26 below the spout 20. The housing also includes a removable cover or lid 28 with a knob. The housing also has an opening through which water and concentrate lines extend to the valve 14. A drain line is connected as usual to the pan below the drip tray/cup support. A transformer 29, which can be located inside the housing 12 provides power to the valve 14.

Figure 2:
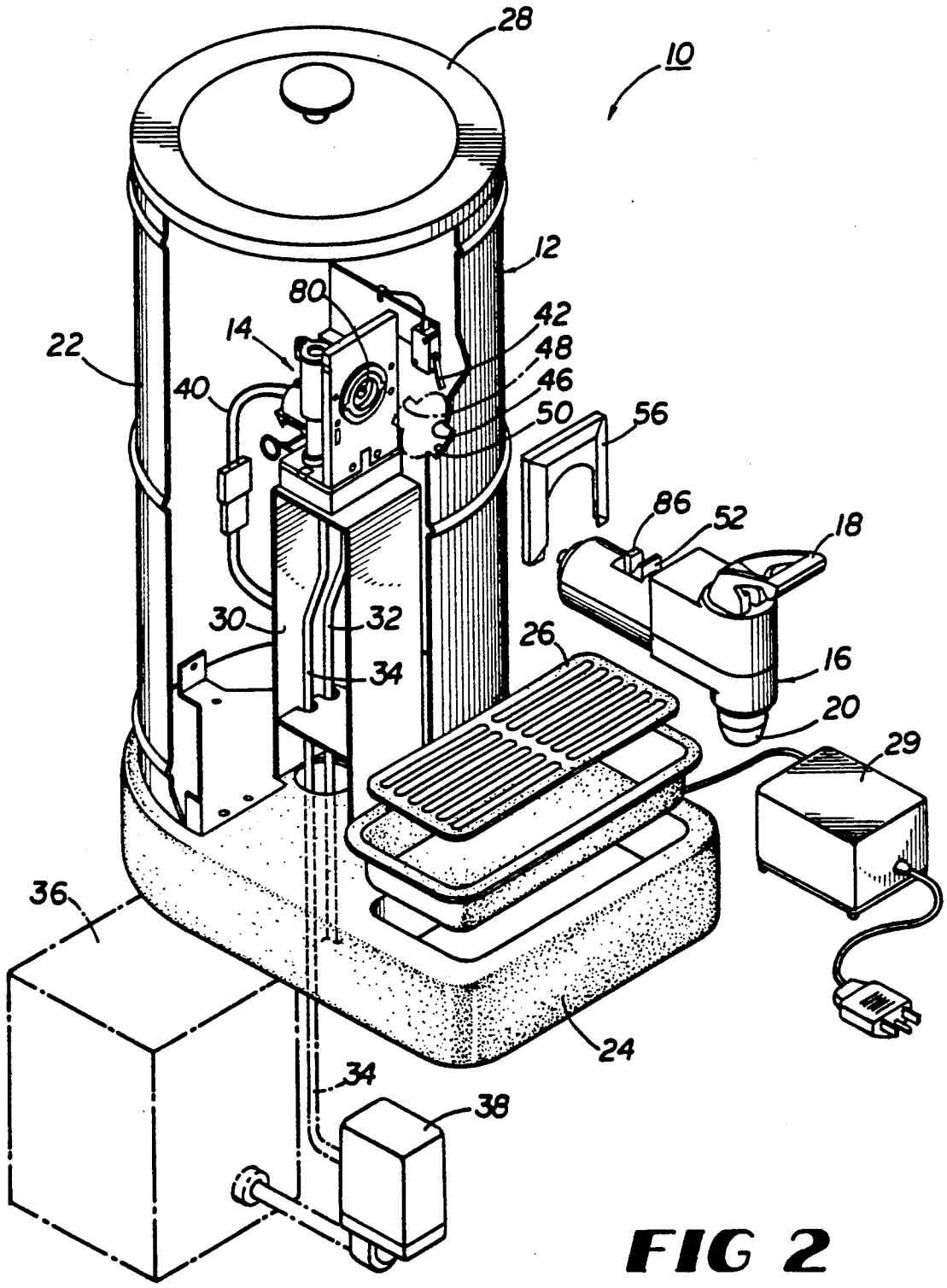
FIG. 2 is a partly broken-away, partly exploded perspective view of the dispenser of FIG. 1.

The valve 14 is preferably that shown in U.S. Pat. No. 4,741,355 but can be any one of a number of postmix beverage dispensing valves which are well-known in the postmix soft drink field. The valve 14 is supported inside the housing on a mounting 30. A water line 32 and a concentrate line 34 extend into the housing to the valve 14. The water line is connected to the local water supply. The concentrate line is connected to a concentrate container 36 of any desired well-known type, such as a bag-in-box used with a pump 38. The valve 14 is connected to an electrical source of power by an electrical line 40. The valve 14 has an on-off switch 42 which is re-located as shown in FIG. 2 to be actuated by the handle 18 as described below. The switch 42 is properly located by a portion of the mounting 30.

Figure 3:
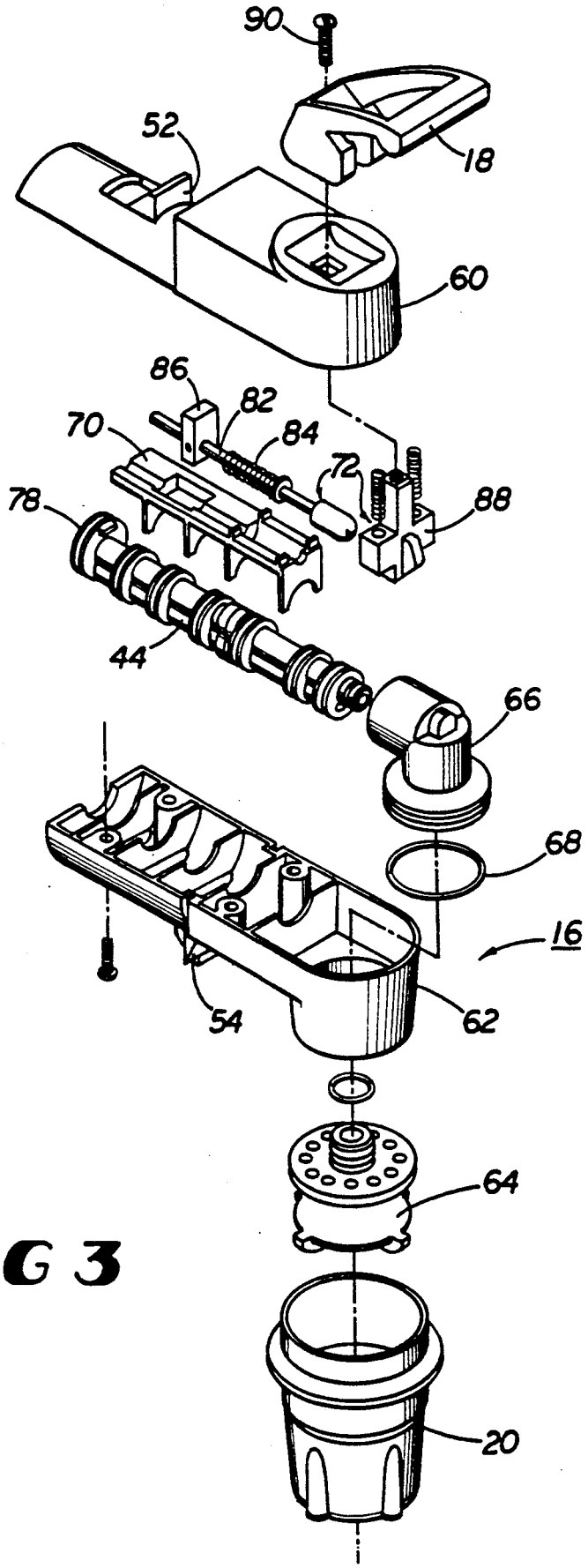
FIG. 3 is an exploded, perspective view of the handle body and nozzle extender used in the dispenser of FIG. 1.
Figure 4:
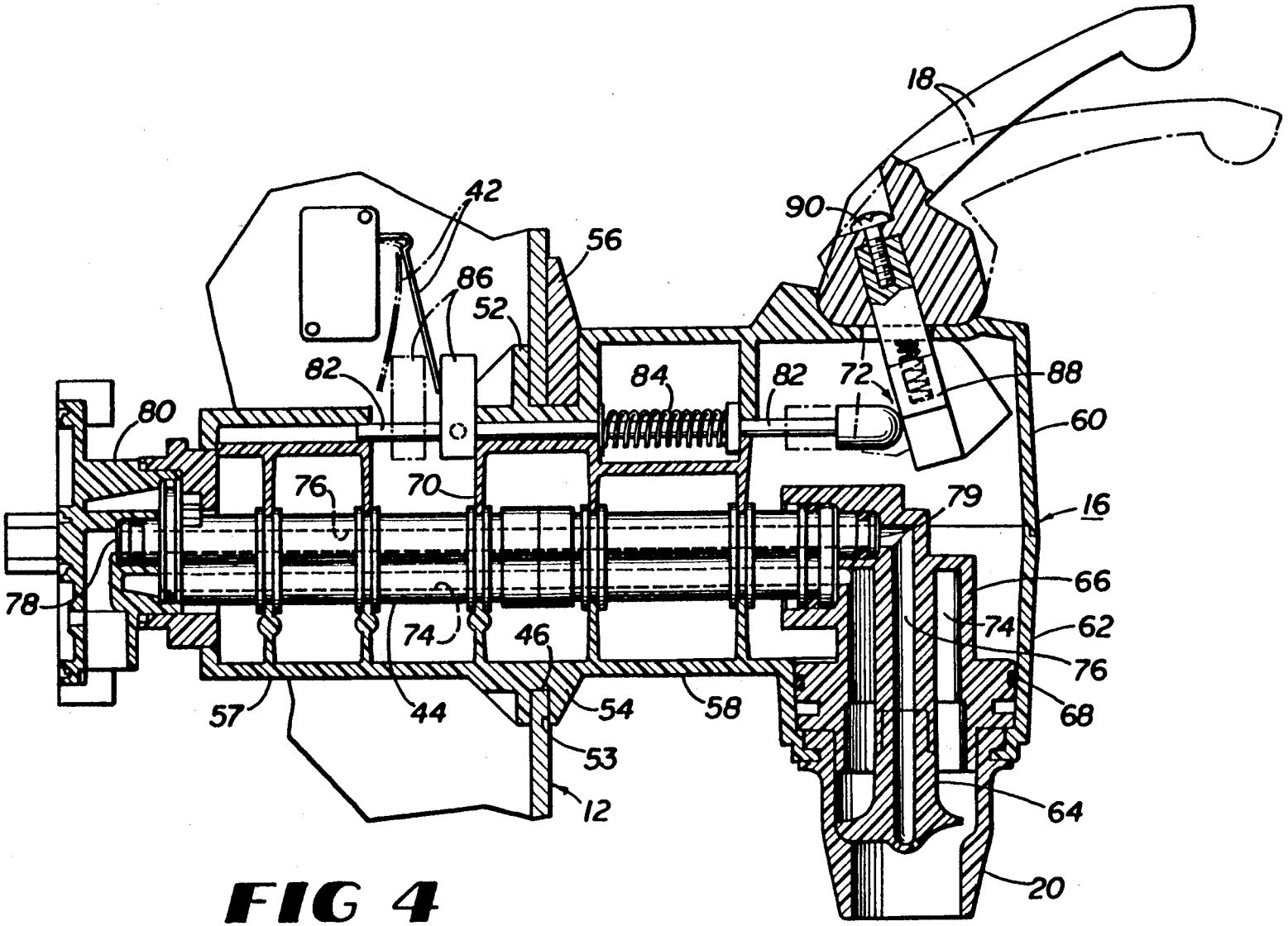
FIG. 4 is a cross-sectional view through the handle body and nozzle extender of FIG. 3.

Referring to FIGS. 3 and 4, the handle body 16 supports the handle 18, the spout 20 and a nozzle extender 44. The handle body 16 is easily manually removable from the housing 12. The body 16 is inserted through a hole 46 having two cutouts 48 and 50 to accommodate two flanges 52 and 54 on the body.

The flange 52 goes inside the housing, and the housing is locked thereto by a retainer 56 described below. The flange 54 has a groove 53 for receiving an edge of the housing defining the hole 46. After the body is inserted through the hole into contact with the valve 14, it is turned slightly to lock it to the wall of the housing and a U-shaped retainer 56 is slid into place, as shown in FIGS. 2 and 4, to complete the locking of the body 16 to the housing. The body 16 includes an inner portion 57 inside the dispenser housing 12 and an outer portion 58 outside the housing 12.

The body 16 includes the handle 18, an upper housing 60, a lower housing 62, the nozzle 20, a diffuser assembler 64, a nozzle interface 66, an O-ring 68, the nozzle extender 44, a support 70, and a switch actuator assembly 72, all assembled as shown in FIGS. 3 and 4.

The nozzle extender 44 includes a water conduit 74 and a concentrate conduit 76. The proximal end 78 of the nozzle extender includes O-rings and mates in fluid-tight relationship with the nozzle 80 of the valve 14. The distal end 79 of the nozzle extender has O-rings and mates sealingly with the nozzle interface 66.

The switch actuator assembly 72 includes a push rod 82 and a spring 84 biasing the rod 82 to the right in FIG. 4. The push rod 82 includes a finger 86 that actuates the on-off switch 42 on the valve 14. The push rod 82 is moved to the left in FIG. 4 when the handle 18 is pulled down, moving the handle extension 88 to the left (as shown in phantom lines in FIG. 4). The push rod 82 is supported for sliding movement between the support 70 and the upper housing 60. The upper housing 60 has an opening for the finger 86. The handle 18 is connected to the handle extension 88 by a screw 90.

Figure 5:
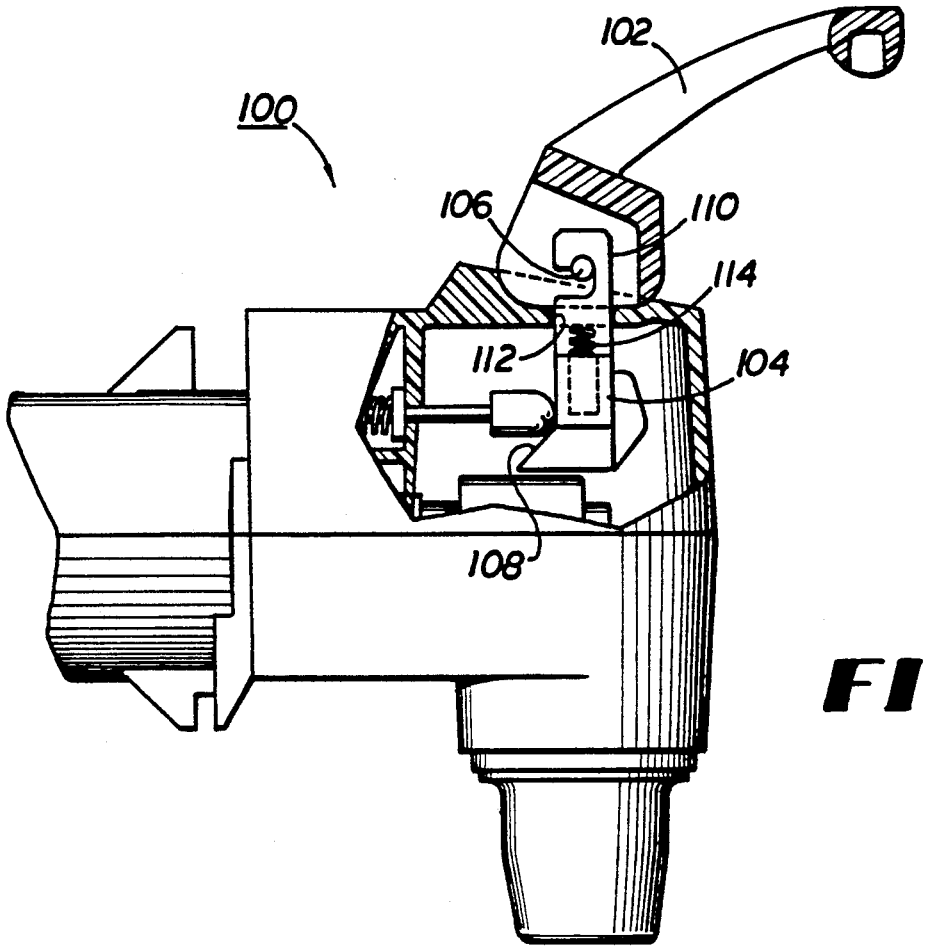
FIG. 5 is a partial cross-sectional view through a portion of a handle body and nozzle extender showing the preferred switch actuator assembly of the present invention.
Figure 6:
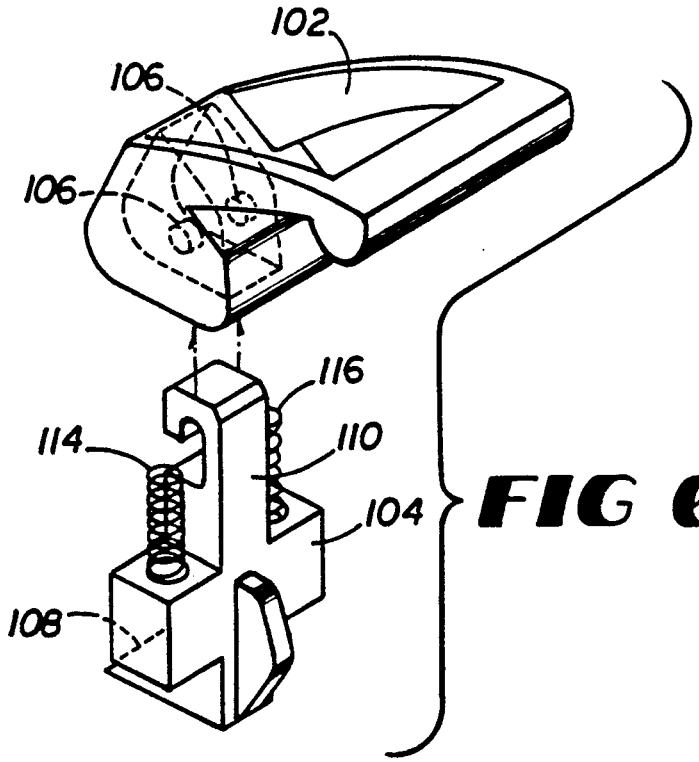
FIG. 6 is an enlarged, partial, exploded perspective view of part of the switch actuator assembly of FIG. 5.

FIGS. 5 and 6 show a preferred embodiment of a switch actuator assembly 100 which is similar to assembly 72 shown in FIGS. 3 and 4 except that assembly 100 allows operation when a handle 102 is pulled down (as in the FIGS. 3–4 embodiment) and also when it is pushed up. The assembly 100 uses the same push rod 82, spring 84, finger 86 and support 70.

The assembly 100 includes a handle 102 connected to a cam element 104 by a pin 106. The cam element 104 having a cam surface 108 is caused to move upwardly (as viewed in FIG. 5) regardless of whether the handle 102 is pushed up or pulled down. This upward movement in turn causes the push rod 82 to move to the left (in FIG. 5) and to actuate the on-off switch 42 on the valve 14.

The cam element 104 includes an elongated neck 110 that reciprocates in opening 112 in the upper housing 60. Springs 114 and 116 bias the cam element downwardly in FIG. 5. The pin 106 fits in a groove 118 on the neck 110.

While the preferred embodiment of this invention has been described above in detail, it is to be understood that variations and modifications can be made therein without departing from the spirit and scope of the present invention. For example, more than one valve 14 and handle and nozzle 20 can be installed in and on the housing 12. Various products other than tea or coffee can be dispensed. Other valves and concentrate containers can be used. The handle can actuate the valve electrically, rather than mechanically, if desired. Other housing shapes than cylindrical can be used, and other locations for the handle can be used.

What is claimed is:

1. A postmix beverage dispenser comprising:

(a) a hollow housing;

(b) a postmix beverage dispensing valve mounted completely inside of said housing and including an on-off switch for operating said valve and having a valve nozzle;

(c) a water line and a concentrate line connected to said dispensing valve;

(d) a handle body connected to said housing and having an inner portion inside of said housing and an outer portion outside of said housing;

(e) a handle connected to said outer portion of said body and movable between an off-position and an on-position;

(f) switch actuating means inside of said body responsive to movement of said handle for energizing said valve on-off switch;

(g) a dispensing nozzle connected to said body; and (h) a nozzle extender including a water conduit and a concentrate conduit therein and located inside of said body and connected at a proximal end thereof to said valve nozzle and at a distal end thereof to dispersing nozzle.

2. The dispenser as recited in claim 1 wherein said housing is a vertically extending metallic cylinder having a round lid with a knob.

3. The dispenser as recited in claim 1 wherein said handle body is removably connected to said housing.

4. The dispenser as recited in claim 1 including a base on which said housing is mounted and said base including a drip tray below said body dispensing nozzle.

5. The dispenser as recited in claim 1 wherein said housing includes an opening for receiving said inner portion and said body having a flange with an annular groove for receiving an edge of said housing defining said openings, when said body is inserted into said opening and rotated, and a retainer for holding said body to said housing.

6. The dispenser as recited in claim 1 wherein said switch actuating means includes a cam element and means for moving said cam element to energize said valve on-off switch both when said handle is pulled down and when it is pushed up.

* * * * *